United States Patent [19]

Oldenburg

[11] 3,974,790

[45] Aug. 17, 1976

[54] BOTTOM FOR PLANING BOATS

[76] Inventor: Bo Julius Oldenburg, Bjalbo, Lidingo, Sweden

[22] Filed: Jan. 20, 1975

[21] Appl. No.: 542,634

[30] Foreign Application Priority Data

Jan. 23, 1974 Sweden ..... 7400832
Nov. 6, 1974 Sweden ..... 7413890

[52] U.S. Cl. ..... 114/66.5 S; 114/56
[51] Int. Cl.[2] ..... B63B 1/20
[58] Field of Search ..... 114/66.5 S, 66.5 R, 114/66.5 F, 56, 67 A

[56] References Cited

UNITED STATES PATENTS

| | | | |
|---|---|---|---|
| 2,039,585 | 5/1936 | Eddy et al. | 114/66.5 R |
| 2,193,892 | 3/1940 | Van Gorden | 114/66.5 R |
| 2,423,860 | 7/1947 | Van Patten | 114/66.5 S |
| 3,111,923 | 11/1963 | Eddy | 114/66.5 R |
| 3,450,085 | 6/1969 | Van Patten | 114/66.5 R |

FOREIGN PATENTS OR APPLICATIONS

| | | | |
|---|---|---|---|
| 831,335 | 8/1938 | France | 114/66.5 S |

*Primary Examiner*—Trygve M. Blix
*Assistant Examiner*—Charles E. Frankfort
*Attorney, Agent, or Firm*—Ladas, Parry, Von Gehr, Goldsmith & Deschamps

[57] ABSTRACT

This invention relates to a step construction for a bottom of planing boats in which the step angle is adjusted to the flow direction of the water under each part of the boat bottom. Each step is so designed that the flow direction of the water when the boat is driven at planing speeds is essentially perpendicular thereto under as great a part of the step as possible.

13 Claims, 16 Drawing Figures

BOTTOM FOR PLANING BOATS

The present invention relates to an improved design and construction of the bottom of planing boats, especially planing motor boats.

It is well-known that the most favourable conditions as regards the water resistance of planing boats are achieved when the boat bottom is provided with one or more transverse steps which subdivide the planing surface in two or more sections. The planing bottom surfaces will then travel over the water surface at an angle of attack which is optimized with a view to the occurring conditions as regards weight, velocity and accessible propelling engine drive. This optimized angle of attack can also remain almost constant independently of the velocity.

In principle the same result can be obtained when one or more of the planing surfaces are subdivided in two parallel parts such as in the so-called threepoint-supported boats. The highest velocities on water have been achieved with such threepoint-supported boats.

Boats provided with steps and threepoint-supported boats have, however, both the disadvantage that they are bumpy and hard in the water, especially in a seaway. For this reason such constructions are now only used for racing, and they have been abandoned for pleasure craft, fast patrol boats and the like.

Boats of the above-mentioned type are nowadays constructed according to a modified planing principle based on a more or less V-bottomed hull without any transverse steps. Such hulls represent a fair compromise between good highspeed characteristics and seaworthiness but the planing conditions at high speeds are not ideal. The angle of attack is too small and the wet surface of the bottom is much larger than would have been the case if the angle of attack had been optimized. For this reason the friction resistance increases considerably with increasing speed.

A certain improvement can be obtained by lubrication of the wet bottom surface with the aid of air or exhaust gases which are introduced and distributed under the bottom surface but such constructions are complicated and this solution has not gained any practical importance.

A certain minor improvement can be obtained with the use of longitudinal spray strips, i.e., strips parallel with the keel, which deflect the spray water which is thrown outwards from the forward part of the wet bottom surface, in a direction downwards and under the boat bottom. However, such spray strips are not effective as regards the major part of the bottom surface where the water flows mainly parallel to the keel and to the strips.

The present invention relates to a step construction for a bottom of planing boats in which the step angle is adjusted to the flow direction of the water under each part of the boat bottom. It is thus essential that each step is so designed that the flow direction of the water when the boat is driven at planing speeds is essentially perpendicular thereto under as great a part of the step as possible. When this is achieved the steps can deflect both the part of the water flow which is directed outwards from the foremost part of the bottom and the water flow which is more or less parallel with the keel below the major part of the aft bottom areas.

Since the steps according to the invention are rather numerous and distributed along the bottom length the same beneficial effect is achieved within a great speed range.

Practical tests have shown that with boats having the length of 4 – 6 meters can give a speed increase of about 20 % within a speed range of up to 20 – 25 knots with unchanged driving force. It has also been found that a boat with a bottom constructed and designed according to the present invention can be turned very abruptly without any risk for capsize.

The invention is thus based upon the observation that the water flow closely under the bottom surface of a conventional planing boat of the V-bottom type does not move parallelly with the keel line of the boat but deflects towards the boat side in dependence of the V-form of the bottom surface which in general is most pronounced in the fore end of the boat and usually is planed aftwards to an increasingly smaller bottom side angle against the horizontal plane. The deflection of the water flow from the lengthwise direction of the boat is thus greatest in the foremost part of the bottom and least in the aftermost part. Further, in general the deflection of the water flow will increase with the transverse distance from the keel line in the forward part of the bottom. In the aftwards direction, however, the water flow becomes increasingly parallel with the keel.

The invention thus relates to a bottom construction for planing boats of the V-hull type which comprises several steps of which at least those located aft of the foremost part of the bottom begin at or near to the chine line of the bottom, whereas the steps in the fore end of the bottom preferably start at a distance from the chine line, in a direction which is essentially parallel with the chine or rather the keel and in the aftwards direction deflect towards the keel and at their end preferably form an essentially right angle to the keel.

The invention is described in more detail in the enclosed drawings, wherein.

Figures 1, 2, 3, 4, 5, 6:
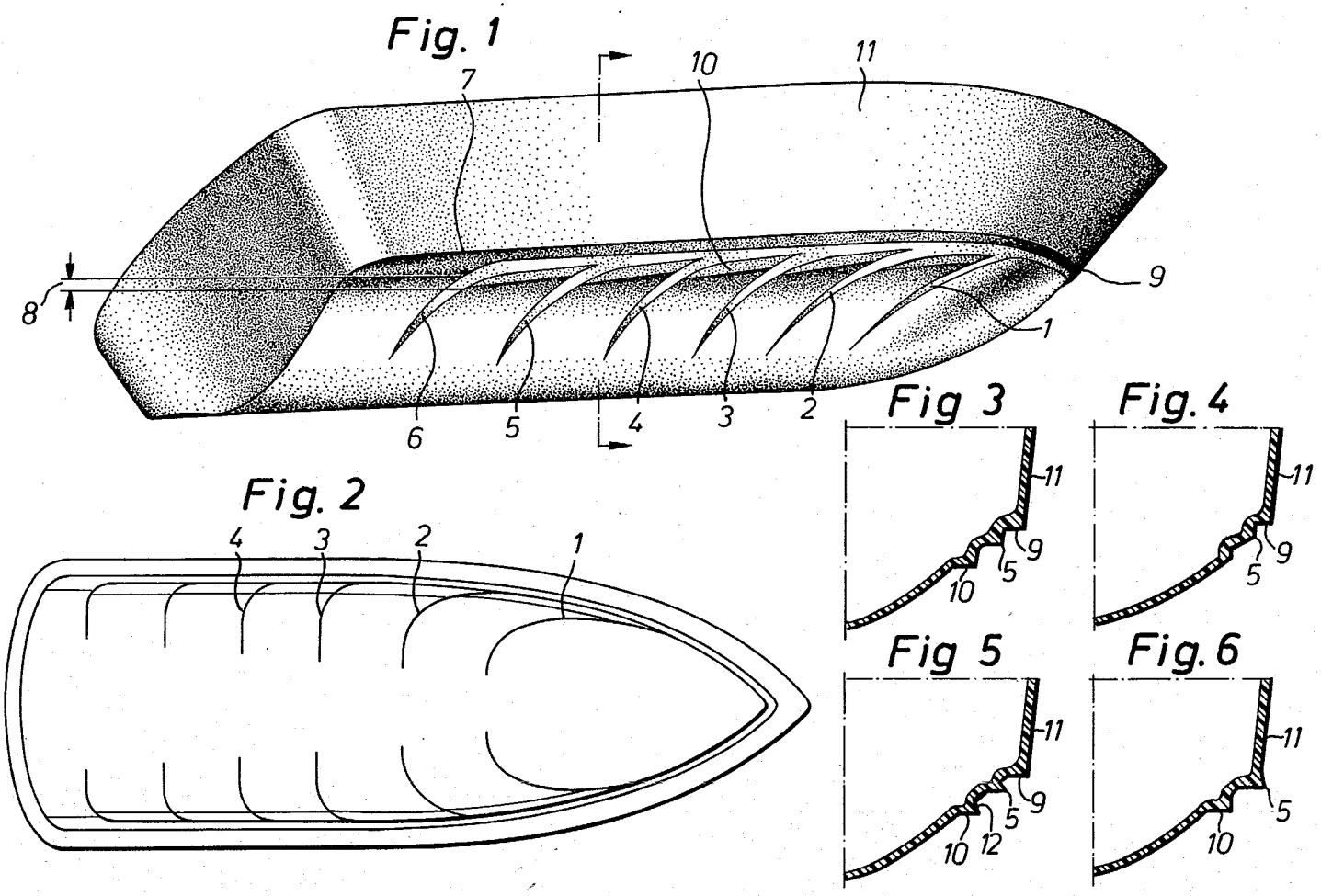
FIG. 1 is a perspective view seen from the aft and from below of a V-bottomed boat provided with steps according to the invention.
FIG. 2 is a perspective view of the same boat bottom as in FIG. 1 seen directly from below.
FIGS. 3 – 6 are sections through the chine of a hull provided with steps according to the invention of different forms.

Thus, FIG. 1 shows a perspective view of a conventional V-bottom hull provided with six steps 1 – 6, counted from the fore end of the boat, designed according to one specific form of the invention. As is obvious from the drawing the foremost step 1 is arranged with its beginning in an angle of about 30° against a tangent to the chine line 7. This angle is successively changed aftwards to a still decreasing angle, viz, the fore end of the step line becomes roughly parallel with the chine. The drawing also shows that it is true for all steps that their height at the beginning of the step line increases along the same in the aftwards direction so as to achieve the greatest height roughly at the center of the step line (cf., the height 8 of step 6 in FIG. 1), whereupon the height is evenly decreased so as to near the keel line (cf., step 1 in FIG. 1) or at a distance therefrom (cf., step 6 in FIG. 1) go towards zero, which means that the step surface at the end of the step line evenly reaches the same plane as the neighbouring bottom surfaces. As is shown in the figure the finishing angle for steps 1 – 6 in relation to the keel line increases from a value of about 30° for step 1 in a direction aftwards to about 90° for step 6.

Further, the drawing shows that the foremost step 1 is extended to a point which is relatively near the keel line, whereas the steps 2 – 6 which are located aftwards are concluded at an evenly increasing distance from the keel line. In this manner a roughly triangular surface is formed around the keel line, the base line of which coincides with the stern edge of the bottom surface, the opposite corner of said triangle being located on the keel line in the foremost part of the bottom surface. As mentioned above this will ensure that the propeller can work in undisturbed water which is of importance for a high degree of efficiency and for avoiding of cavitation.

In the form shown in FIG. 1 the hull is along the chine provided with a plane 9. The presence of such a plane is, however, not strictly necessary for obtaining the advantages according to the invention. The function of the plane 9 is rather to protect the steps mechanically but it can also be ascribed a certain esthetical importance. However, the essential function of the plane 9 is to facilitate the suction of air into the back side of the steps.

FIG. 1 relates to a basic form of the invention in which the steps 1 – 6 are provided with mainly horizontally planed step surfaces essentially parallel with the lengthwise direction of the boat, e.g., the surface 10 of step 5. The said planed step surfaces improve the effect achieved and further deflect the water from the plane 9 along the chine.

FIG. 2 shows a perspective view from the aft and the below of the same bottom as FIG. 1 and the figures refer to the same details as those mentioned in connection with the explanation of FIG. 1.

FIG. 3 is a section of the hull near the chine along the line indicated in FIG. 1 at step 5, showing part of the hull side 11, the plane 9 along the chine, the step 5 with its horizontally planed part 10.

FIG. 4 shows an alternative form of the one elucidated in FIG. 3. The difference in this case is only that the step surface from the step edge is mainly straight so that plane 10 has been omitted.

FIG. 5 shows the same form of a step as FIG. 3, but with the difference that a recess 12 has been arranged along the whole of the vertical part of the step.

FIG. 6 finally shows an alternative form corresponding to the one shown in FIGS. 1 – 3 but with the difference that the plane 9, which is extended along the chine, has been omitted.

According to the specific form of the bottom construction according to the invention described above each step is finished at a distance from the keel line which distance increases stepwise in the aftwards direction which will ensure that the propeller always can work in undisturbed water. However, according to a preferred form of the invention all steps are finished at the same distance from the keel. The reason for this is that it has been found to be advantageous to arrange lengthwise strips parallel with the keel (spray steps) or channels on each side of the keel so as to lead away air entering under the boat bottom from the propeller water flow.

A step in a bottom construction according to this modification of the invention can at its beginning have a relatively small height, e.g., in the foremost steps, but in that case the height will increase in the aftwards direction along the step line. At the conclusion of the step in the direction towards the keel line the height decreases in the form of the invention described in FIGS. 1 and 2 towards zero the step plane will then evenly join the bottom parts located near the keel. According to the specific form of FIG. 7 the step will, however, essentially maintain its height all the way to its ending near or at a distance from the keel line. In this specific form the finish of the step, i.e., the decrease of the step height towards zero, is made in a direction aftwards which is essentially parallel with the keel line, preferably so that the step height becomes zero at a point near the neighboring step in the aftwards direction.

Figure 7:
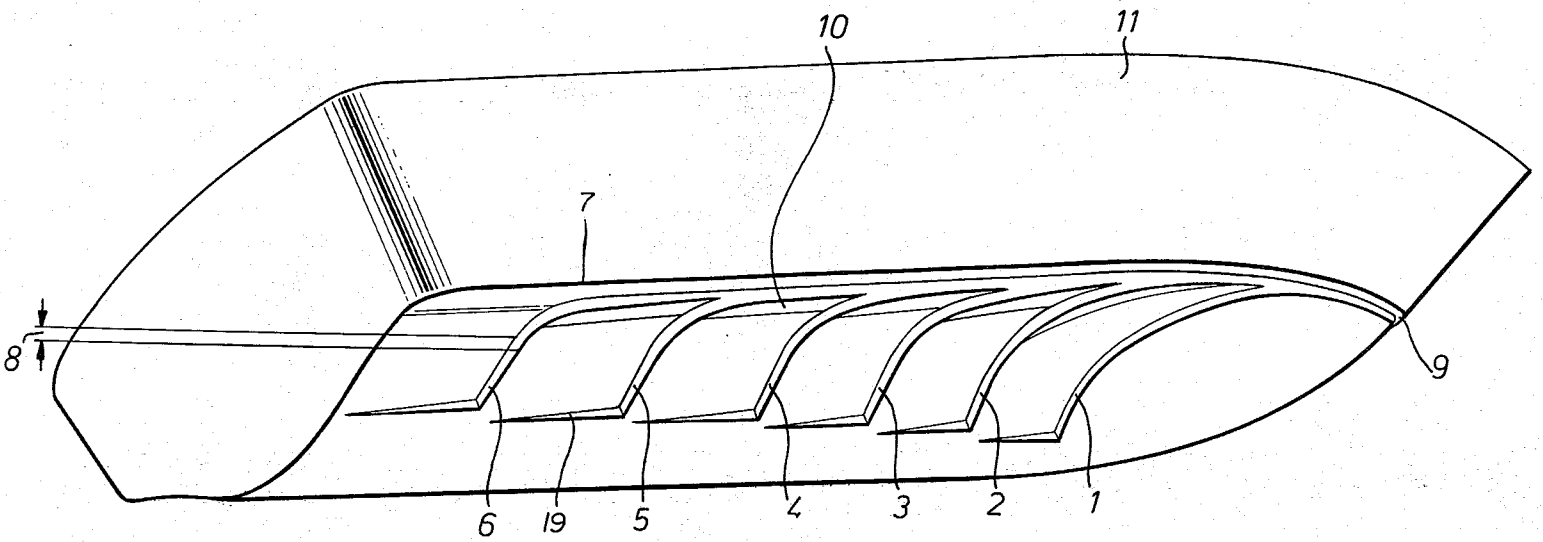
FIG. 7 is a perspective view seen from the aft and from below of another specific form of the bottom construction according to the invention.
Figure 8:
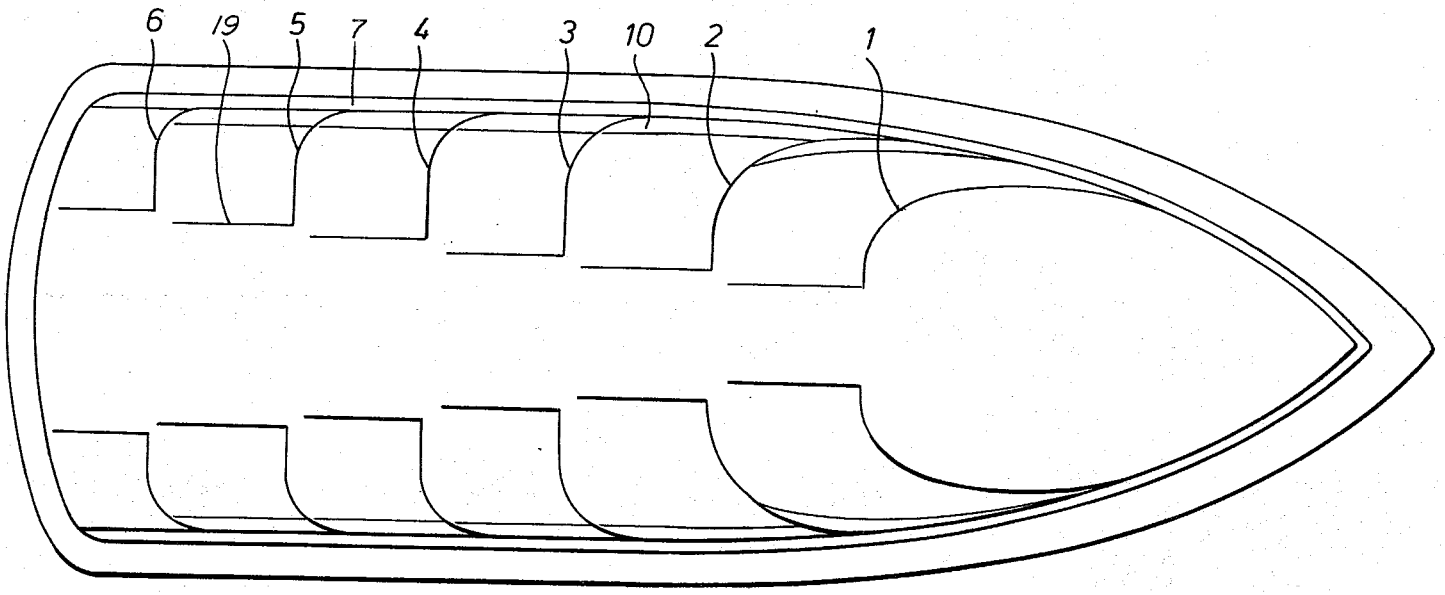
FIG. 8 shows the same construction as FIG. 7 but in this case seen directly from below.
Figure 9:
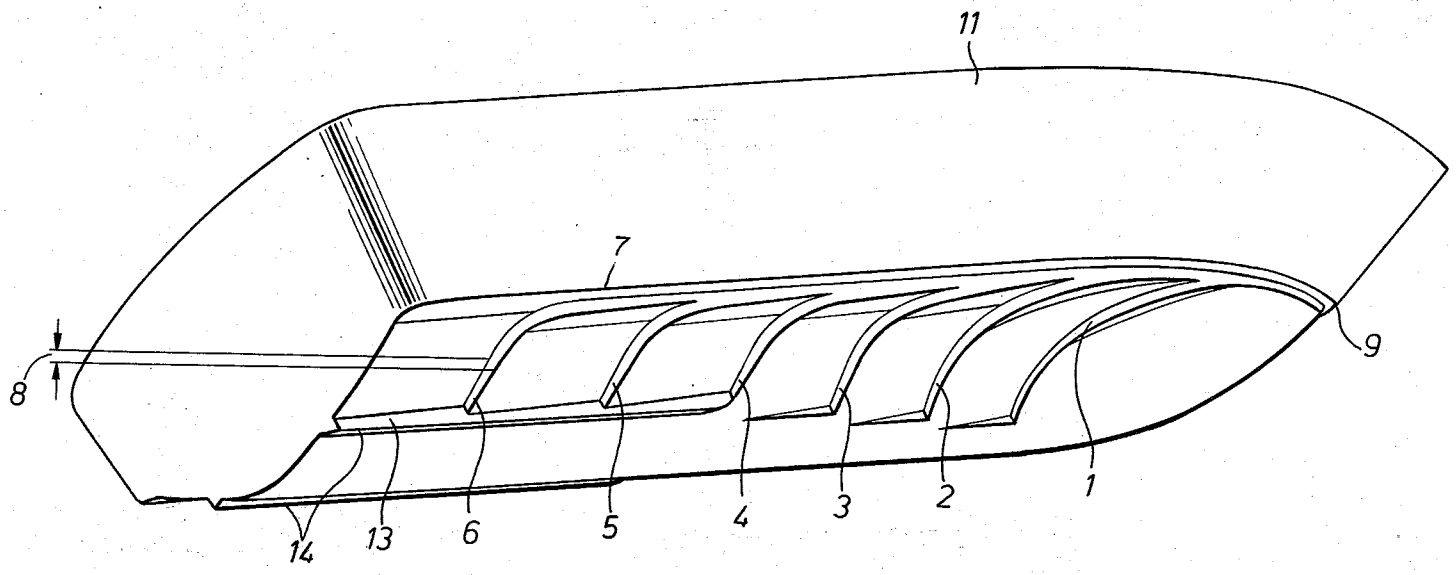
FIG. 9 shows a perspective view of a further modified specific form of the step construction according to the invention, in this case provided with lengthwise steps on the after half of the boat bottom.
Figure 10:
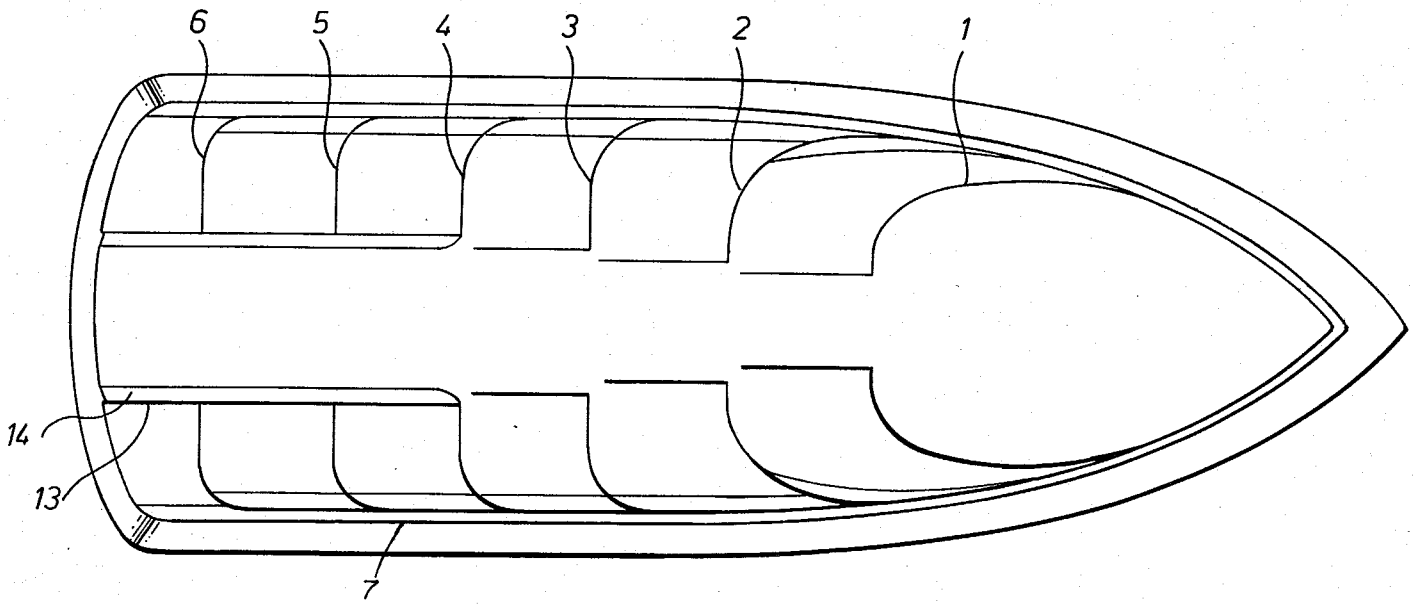
FIG. 10 shows the same construction as FIG. 9 seen directly from below.

Thus, in the specific form elucidated in FIGS. 7 and 8 essentially triangular planes which are essentially parallel with the keel are formed (cf., 19 in FIGS. 7 and 8) which contribute to prevent air to enter the propeller water stream from the back side of the steps. A further improvement of this air deflecting effect is obtained by providing the stepped boat bottom with lengthwise strips as is shown in FIGS. 9 and 10 (13, 14), which form an essentially vertical surface in a direction towards the side of the boat and which is extended from the stern over several steps forwards as needed. However, it is preferred to arrange the said lengthwise strips along the whole of the boat bottom and in that case all steps are of course finished at the same distance from the keel line.

Figure 11:
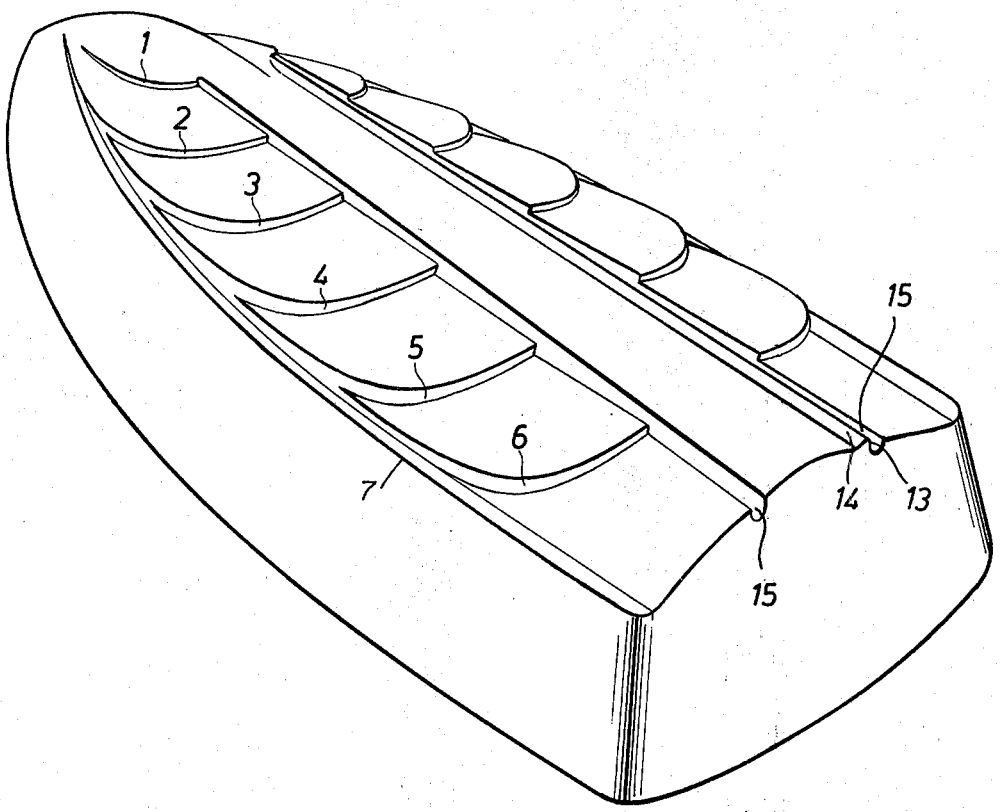
FIG. 11 shows a further improved modification of the boat bottom according to the invention, in this case provided with lengthwise channels parallel with the keel at the conclusion of the steps near the keel.
Figure 15:
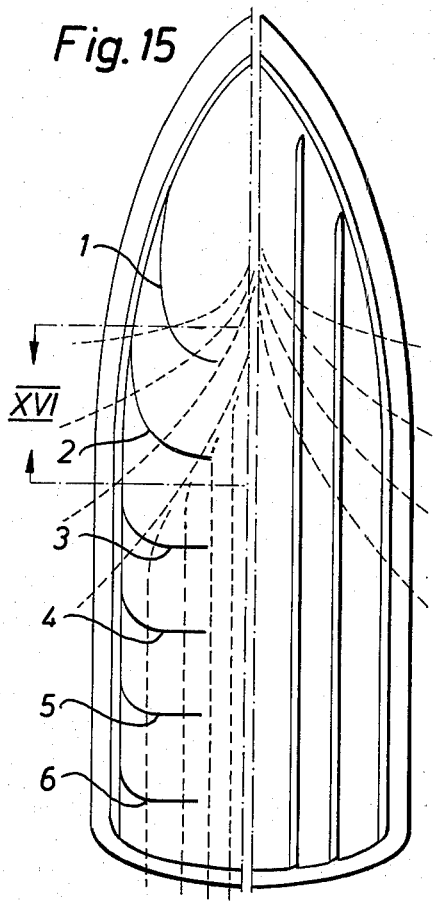

An effect similar to the one obtained with the lengthwise arranged strips (13, 14) can also be obtained by providing channels at a distance from the keel line near the end of the steps FIGS. 11, 15) which are sunk into the hull and in which air entering at the back edge of the steps can be deflected aftwards without any possibility to disturb the propeller so as to cause cavitation.

It is, of course, also possible to combine the strips 13 and 14 mentioned in connection with FIGS. 9 and 10 with the lengthwise channels 15 in FIG. 11 for obtaining of a still improved effect. In this case it is most suitable to arrange the channel in immediate connection with the ending of the steps and the lengthwise strips are then arranged insides of the channels in the direction towards the keel. Such a form is diagrammatically elucidated in FIG. 11, in which the left hull section is provided with a channel 15, whereas the right hull section is provided with a channel 15 as well as with a lengthwise strip 13, 14.

It is obvious from the above statements that the essentially triangular and essentially vertical surfaces 19 at the back of the steps in combination with the lengthwise strips 13, 14 and/or the channels 15 will prevent air sucked in at the back edges of the steps to enter the propeller water flow so as to cause cavitation.

Figure 12:
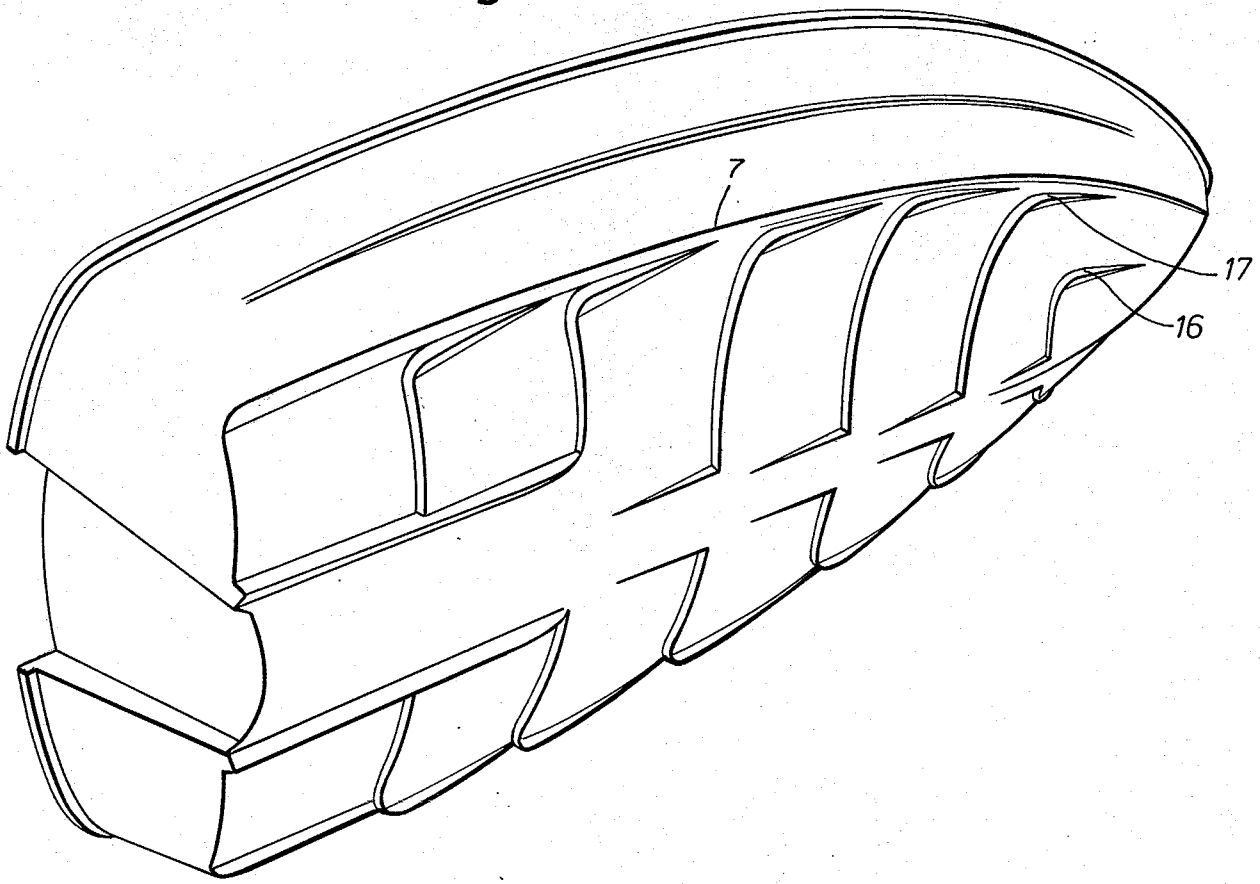
FIG. 12 shows a further specific form of the bottom construction according to the invention seen from below and from the aft, which has a modified location of the foremost steps.

FIG. 12 elucidates an especially preferred form of the boat bottom according to the invention which is similar to the one described in FIGS. 9 and 10. However, in this specific form the foremost steps, suitably those present in the foremost fourth of the bottom length, have been begun at a distance from the chine line which decreases aftwards during the said fourth of the bottom. In this specific form the foremost step is preferably begun roughtly between the keel and the chine and the steps closest in the aftwards direction will then begin at a still more increasing distance from the keel line.

The most preferred form of the invention is the one elucidated in FIG. 12 but with the difference that the lengthwise strips 13, 14 are extended along all of the steps. This will ensure a maximal prevention of the occurrance of cavitation when the boat is turned sharply.

Figure 13:
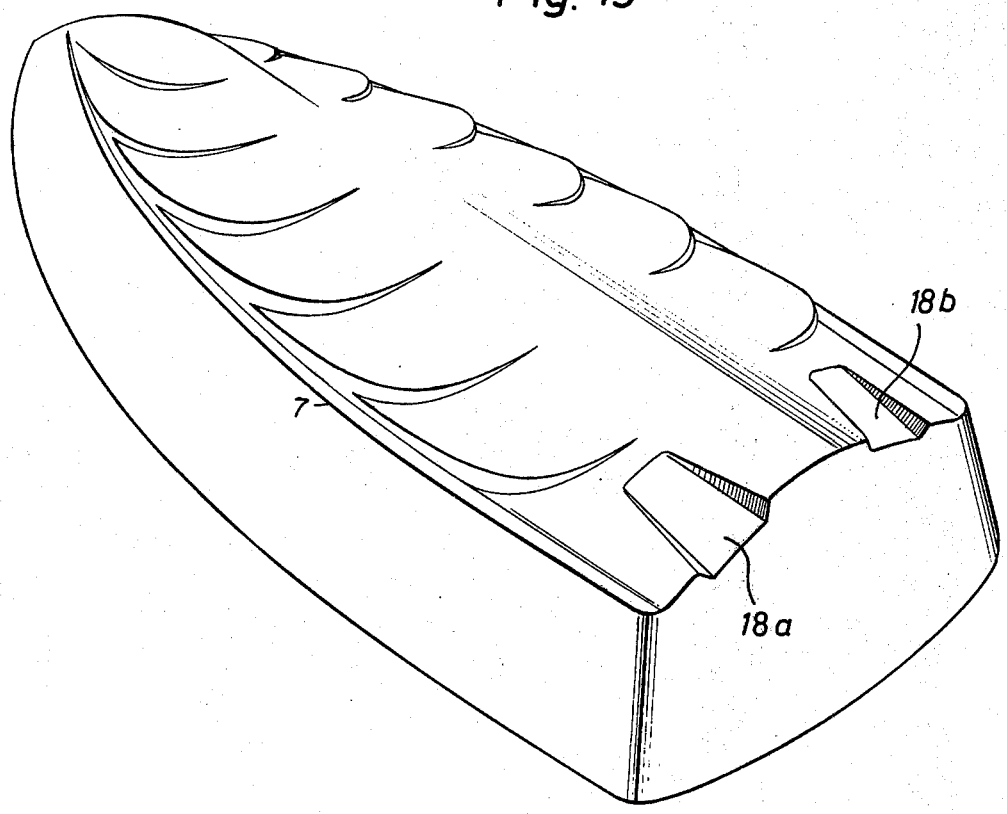
FIG. 13 shows a specific form of the boat bottom construction according to the invention intended for twin engines.

The above-described specific forms of the invention are intended for single engine boats. When twin engines are used the above-described forms are not suitable. However, in FIG. 13 a specific form is elucidated which is suitable for twin engines. In this specific form the previously described lengthwise strips 13, 14 and the channels 15 are, of course, omitted. The said elements are in the form elucidated in FIG. 13 replaced with wedge-formed hollows 18*a*, 18*b* located on the boat bottom on both sides of the keel. The air which may enter at the back edges of the steps will, of course, flow along the surface of the boat bottom and the wedge-formed hollows will allow such air to raise upwards so as to ensure the propellers undisturbed water.

Figure 14:
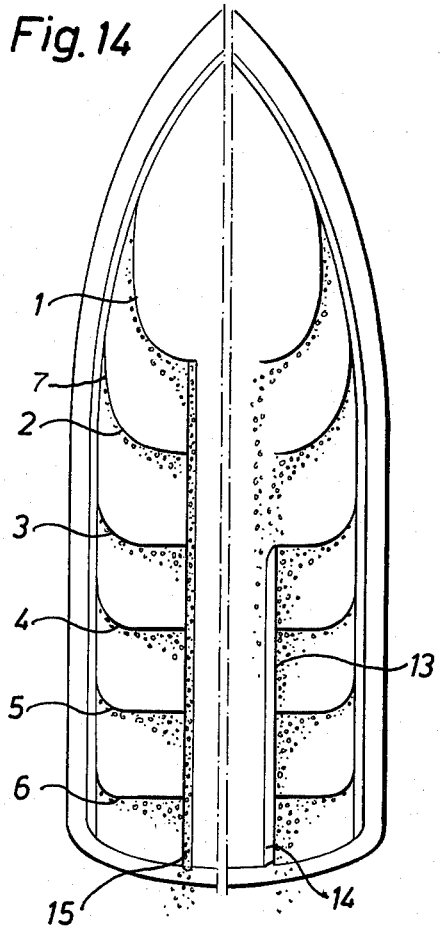
FIGS. 14 – 16 show diagrammatically the experimentally established water flow below a boat bottom according to the invention and the distribution of air sucked in at the back edge of the steps.
Figure 16:
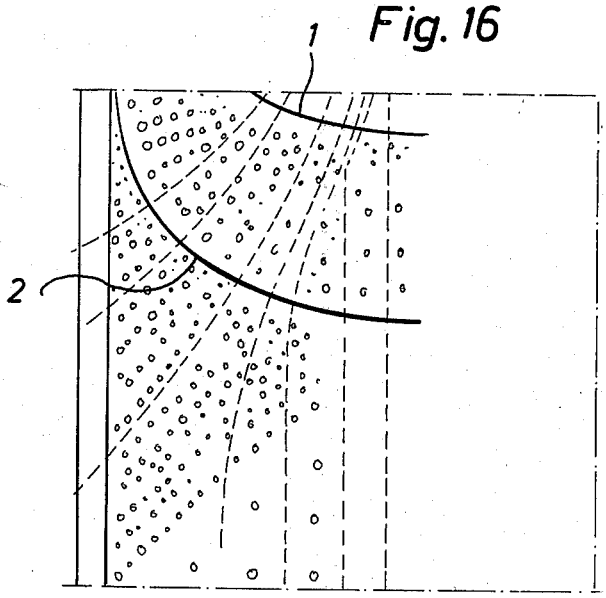

Practical experiments have shown that the water flow under the bottom of a planing V-hulled boat has a relatively peculiar direction distribution. FIG. 15 elucidates the water distribution under the boat bottom at planing speeds established by practical experiments, viz, along the dotted lines. The left part of the hull shown is provided with steps according to the invention, whereas the right hull half is provided with longitudinal conventional spray strips. As is shown by the dotted lines a very sharp deflection of the water flow occurs at the foremost part of the boat bottom in both cases. This deflection is especially notable near the chine of the boat bottom but it becomes increasingly lesser pronounced in a direction aft and in a direction towards the keel. In FIG. 16 the flow direction determined by practical experiments under step 2 in FIGS. 15 and 2 is shown. FIG. 16 is a magnification of the part indicated in FIG. 15 and shows the air sucked in at the back edge of the steps and its distribution with small circles. It is clearly shown that the air sucked in at the back edge of the steps is essentially distributed in the flow direction of the water and the air has a posibility to be sucked into the propeller water stream when the above-mentioned longitudinal strips 13, 14 and/or the channels 15 are not provided. FIG. 14 also elucidates the advantage of extending the strips 13, 14 and/or the channel 15 along the whole of the boat bottom. If this is done one obtains a maximally undisturbed propeller water stream also when the boat is turned sharply so as to encourage air to be pressed in under the boat bottom, especially at the back edges of the steps.

According to the invention it has further been shown that the number of steps is of importance. The greatest flexibility, i.e. the maximal benefit under a wide speed range, is thus obtained with the use of relatively short distances between the steps. It is preferred that the step distance is in the range 20 – 120 cms., preferably 30 – 60 cms. The corresponding step height is in the range 10 – 120 mms., preferably 20 – 80 mms.

It is obvious that the forms of the invention described above and in the drawings can be further modified without deviation from the inventive thought. Such modifications are obvious to the expert and will fall within the scope of the invention.

I claim:

1. A bottom for planing boats comprising a plurality of steps located on said bottom, at least said steps on the rearward portion of said bottom being located substantially at the chine line of the bottom, said steps located on the forward portion of said bottom being spaced from the chine, the rearward portion of said steps being curved and the outward and forward portion thereof being substantially parallel to the keel of said bottom and the rearward and inward portion being spaced from said keel and being substantially perpendicular thereto, said curve of said step being a substantially smooth curve, and the maximum deflection of said curve being greater substantially at the middle portion of said steps, whereby the curve is substantially perpendicular at every point thereon to the direction of flow of water when the boat is planing.

2. A bottom for planing boats according to claim 1, wherein the height of said steps at the forward portion thereof is minor and increases evenly in the rearwardly direction to a maximum at the middle portion of the steps.

3. A bottom for planing boats according to claim 2, wherein a portion of the surface of at least one step located essentially at the forward portion extending to and including the portion of the maximum deflection of the curve is of a lesser slope in relation to the horizontal plane than the neighboring portions of said steps to form a plane, said plane extending essentially in the longitudinal direction with respect to the bottom.

4. A bottom for planing boats according to claim 1, wherein said height of said steps inwardly of said middle portion evenly decreases to zero as the distance from said chine increases.

5. A bottom for planing boats according to claim 1, wherein the outward and forward portion of said steps forms an angle of from 0° to 10° with the chine.

6. A bottom for planing boats according to claim 1, wherein the distance from the front to the back of said steps is in the range of from 20 to 120 cms.

7. A bottom for planing boats according to claim 6, wherein the maximum height of said steps is in the range of from 10 to 120 mms.

8. A bottom for planing boats according to claim 1, wherein the steps that are spaced from said chine are in the forward quarter of said bottom, said distance between said step and said chine decreasing with each rearwardly located step.

9. A bottom for planing boats comprising a plurality of steps located on said bottom, at least said steps on the rearward portion of said bottom being located substantially at the chine line of the bottom, said steps located on the forward portion of said bottom being spaced from the chine, the rearward portion of said steps being curved and the outward and forward portion thereof being substantially parallel to the keel of said bottom and the rearward and inward portion being spaced from said keel and being substantially perpendicular thereto, said curve of said step being a substantially smooth curve, and the maximum deflection of said curve being greater substantially at the middle portion of said steps, the height of said steps at the forward portion thereof is minor and increases evenly in the rearwardly direction to a maximum at the middle portion of the steps, the height of said steps located inwardly of said middle portion being substantially the same as the height of said middle portion, and at least one triangular surface located at the rearward and inward portion of at least one of said steps being of substantially triangular configuration and defining a substantially vertical surface located on said bottom, said triangular surface extending substantially parallel with the keel.

10. A bottom for planing boats according to claim 9, further comprising a plurality of longitudinal strips, at least one of said strips being located on each side of the keel of said bottom, said strips being in juxtaposition with at least one of said triangular surfaces and having a substantially vertical outwardly facing surface.

11. A bottom for planing boats according to claim 9, wherein the sides of the steps are concaved.

12. A bottom for planing boats comprising a plurality of steps located on said bottom, at least said steps on the rearward portion of said bottom being located substantially at the chine line of the bottom, said steps located on the forward portion of said bottom being spaced from the chine, the rearward portion of said steps being curved and the outward and forward portion thereof being substantially parallel to the keel of said bottom and the rearward and inward portion being spaced from said keel and being substantially perpendicular thereto, said curve of said step being a substantially smooth curve, and the maximum deflection of said curve being greater substantially at the middle portion of said steps, the height of said steps at the forward portion thereof is minor and increases evenly in the rearwardly direction between maximum at the middle portion of the steps, the height of said steps located inwardly of said middle portion being substantially the same as the height of said middle portion, and at least one triangular surface located at the rearward and inward portion of at least one of said steps being of substantially triangular configuration, and defining a substantially vertical surface located on said bottom, said triangular surface extending substantially parallel with the keel, and a plurality of longitudinal channels being located in said bottom, said channels being substantially parallel with the keel and located inwardly of said steps on either side of the keel.

13. A bottom for planing boats comprising a plurality of steps located on said bottom, at least said steps on the rearward portion of said bottom being located substantially at the chine line of the bottom, said steps located on the forward portion of said bottom being spaced from the chine, the rearward portion of said steps being curved and the outward and forward portion thereof being substantially parallel to the keel of said bottom and the rearward and inward portion being spaced from said keel and being substantially perpendicular thereto, said curve of said step being a substantially smooth curve, and the maximum deflection of said curve being greater substantially at the middle portion of said steps, the height of said steps at the forward portion thereof is minor and increases evenly in the rearwardly direction between maximum at the middle portion of the steps, the height of said located inwardly of said middle portion being substantially the same as the height of said middle portion, and at least on triangular surface located at the rearward and inward portion of at least one of said steps being of substantially triangular configuration, and defining a substantially vertical surface located on said bottom, said triangular surface extending substantially parallel with the keel, and a plurality of longitudinal channels being located in said bottom, said channels being substantially parallel with the keel and located inwardly of said steps on either side of the keel, and a plurality of longitudinal strips located on either side of said keel, said strips being in juxtaposition with said triangular surfaces and having a substantially vertical surface facing outwardly, said longitudinal strips and said channels being disposed parallel to each other, said channels being located outwardly of said strips.

* * * * *